US011746515B2

(12) United States Patent
Tang

(10) Patent No.: US 11,746,515 B2
(45) Date of Patent: Sep. 5, 2023

(54) PRESSING PANEL

(71) Applicant: XIAMEN R&J PRECISION TECHNOLOGY CO., LTD., Fujian (CN)

(72) Inventor: Yaping Tang, Hubei (CN)

( * ) Notice: Subject to any disclaimer, the term of this patent is extended or adjusted under 35 U.S.C. 154(b) by 0 days.

(21) Appl. No.: 17/912,079

(22) PCT Filed: Feb. 3, 2021

(86) PCT No.: PCT/CN2021/074981
§ 371 (c)(1),
(2) Date: Sep. 16, 2022

(87) PCT Pub. No.: WO2021/223475
PCT Pub. Date: Nov. 11, 2021

(65) Prior Publication Data

US 2023/0140602 A1 May 4, 2023

(30) Foreign Application Priority Data

May 7, 2020 (CN) ..... 202010375424.1

(51) Int. Cl.

| | |
|---|---|
| ***E03D 5/09*** | (2006.01) |
| ***G05G 1/01*** | (2008.04) |
| ***G05G 1/04*** | (2006.01) |
| ***G05G 5/05*** | (2006.01) |

(52) U.S. Cl.
CPC ..... *E03D 5/09* (2013.01); *G05G 1/01* (2013.01); *G05G 1/04* (2013.01); *G05G 5/05* (2013.01); *G05G 2505/00* (2013.01)

(58) Field of Classification Search
CPC .. G05G 1/01; G05G 1/04; G05G 5/05; G05G 2505/00; E03D 5/09
See application file for complete search history.

(56) References Cited

U.S. PATENT DOCUMENTS 1,626,722 A * 5/1927 Cole ..... G05G 5/05 74/513
10,946,741 B1 * 3/2021 Kim ..... B60T 7/06
11,550,353 B1 * 1/2023 Kim ..... G05G 1/015

FOREIGN PATENT DOCUMENTS

CN 202039431 U * 11/2011
CN 205369441 U * 7/2016
CN 205530531 U * 8/2016
(Continued)

*Primary Examiner* — Adam D Rogers

(57) ABSTRACT

A pressing panel, including a panel, buttons and elastic pieces; the buttons are hinged to the panel, and each button is movable with respect to the panel through a pair of hinge shafts; each button is fixedly provided with an elastic piece; each elastic piece is provided with an elastic supporting arm extending backwards; each elastic supporting arm abuts the panel; when each button moves, a portion of a corresponding elastic supporting arm corresponding to an abutting position of the corresponding elastic supporting arm and the panel slides; when each button is in an initial state before being pressed, the abutting position between the corresponding elastic supporting arm and the panel, compared with a position of the corresponding pair of hinge shafts, is farther away from a fixing position between the button and the corresponding elastic piece; when pressing each button, the corresponding elastic piece moves along with the button.

5 Claims, 10 Drawing Sheets

(56) References Cited

FOREIGN PATENT DOCUMENTS

| | | | | | |
|---|---|---|---|---|---|
| CN | 108343137 | A | * | 7/2018 | ..... E03D 11/02 |
| CN | 212294918 | U | * | 1/2021 | ..... E03D 5/09 |
| CN | 113216339 | A | * | 8/2021 | |

* cited by examiner

PRESSING PANEL

BACKGROUND OF THE INVENTION

The present invention relates to the field of pressing panels, and more particularly a pressing panel which is easy and comfortable to press.

Conventional drive panels of concealed water tanks are panels provided with single-row buttons or double-row buttons. After pushing a button, a resetting mechanism is required to drive the button back to an initial position. The resetting mechanism in the prior art generally uses elastic pieces such as flat springs or torsion springs, wherein a fixing point of each elastic piece is placed on a panel body, and a supporting point of each elastic piece is placed on the button. After pressing the button, the fixing point of each elastic piece remains unchanged, while a portion between the supporting point and fixing point starts deforming; the larger the pressing depth, the greater the deformation and the rebound resistance against the button, thus requiring larger pressing force and being uncomfortable to press.

BRIEF SUMMARY OF THE INVENTION

In view of the above, the present invention provides a pressing panel with an improved connecting structure, which is easy and comfortable to press.

To attain the above object, the present invention provides the following technical solutions:

A pressing panel, comprising a panel, buttons and elastic pieces; the buttons are hinged to the panel, and each button is movable with respect to the panel through a pair of hinge shafts; each button is fixedly provided with a corresponding elastic piece; each elastic piece is provided with an elastic supporting arm extending backwards corresponding to a direction which a corresponding button moves when being pressed; each elastic supporting arm abuts the panel by elastic force; when each button moves with respect to the panel through a corresponding pair of hinge shafts, a portion of a corresponding elastic supporting arm corresponding to an abutting position between the elastic supporting arm and the panel slides; when each button is in an initial state before being pressed, the abutting position between the corresponding elastic supporting arm and the panel, compared with a position of the corresponding pair of hinge shafts, is farther away from a fixing position between the button and the corresponding elastic piece.

Further preferably, the elastic pieces are elongated flat springs or elongated elastic threads.

Further and more preferably, each elastic piece has an arched structure, and a middle part of each elastic piece is provided with a concave part; a fitting base provided with a fitting hole is formed on each button; each elastic piece passes through a corresponding fitting hole; a first end and a second end of each elastic piece abut the corresponding button and the panel respectively, wherein the concave part at the middle part of each elastic piece is fixedly fitted with a corresponding fitting base by elastic force of the elastic piece itself; each elastic supporting arm is defined by an elastic part of the corresponding elastic piece between the concave part and the second end thereof.

Further and more preferably, a guiding incline is provided for each button between the fitting base of the button and an abutting position between the button and the first end of the corresponding elastic piece.

Further and more preferably, a position limiting structure is provided on each button at the abutting position between the button and the first end of the corresponding elastic piece.

Further and more preferably, the position limiting structure is defined by a pair of first protrusions formed integrally with each button on two sides of the corresponding elastic piece respectively.

Further and more preferably, the elastic pieces are torsion springs.

Further and more preferably, each button is provided with a fixing shaft; each torsion spring is fixedly fitted with a corresponding fixing shaft, wherein a first supporting arm of each torsion spring abuts the corresponding button, and a second supporting arm of each torsion spring abuts the panel; the elastic supporting arm is embodied as the second supporting arm when the elastic pieces are torsion springs.

Further and more preferably, a position limiting groove extending along a sliding path of each elastic supporting arm is provided on the panel corresponding to the abutting position between the elastic supporting arm and the panel.

Further and more preferably, the position limiting groove is defined by a pair of second protrusions formed integrally with the panel on two sides of the corresponding elastic piece respectively.

Further and preferably, two hinging columns are provided at one side of each button at two positions spaced apart from each other respectively; each button is hinged to the panel through two corresponding hinging columns; the corresponding elastic piece is provided between the two corresponding hinging columns.

Further and preferably, the panel is provided with a front surface, and a rear surface provided on a back side of the front surface; the buttons and the elastic pieces are provided on the rear surface of the panel; accommodating windows are formed on the front surface of the panel corresponding to positions of the buttons.

Further and more preferably, the rear surface of the panel is provided with blocking hooks extending backwards; when pressing each button, each button rotates backwards to a certain degree and abuts a corresponding blocking hook, thereby being limited from further rotation by the corresponding blocking hook.

Further and more preferably, each button is provided with a convex pressing part extending towards a corresponding accommodating window.

The beneficial effects of the technical solutions provided by the present invention are as follows:

When the elastic piece is fixed onto a movable component, namely the button, a supporting point of the elastic piece is positioned on the panel body, and the elastic piece slidably abuts the panel at the supporting point; when pressing the button, the elastic piece moves along with the button; a sliding motion of the elastic supporting arm of the elastic piece effectively offsets the deformation of the elastic piece, so that the deformation of the elastic piece is small, and therefore the rebound resistance against the pressing force of the button is not large; therefore, during a pressing process of the button, changes of pressing force are small; in comparison to the prior product, the pressing panel of the present invention is easier and more comfortable to press.

DETAILED DESCRIPTION OF THE INVENTION

Figure 1:
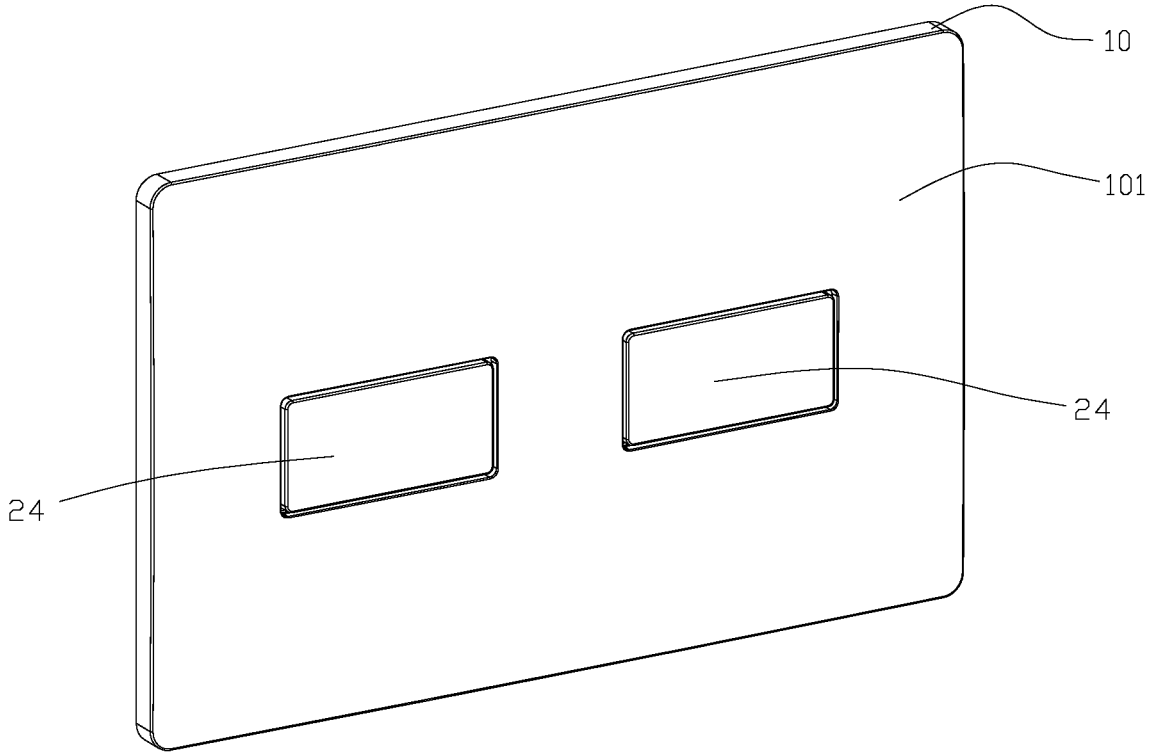
FIG. 1 shows a front perspective view of the pressing panel of embodiment one in an initial state.

To further explain the embodiments, the present invention is provided with accompanying drawings; the accompanying drawings are part of the disclosure of the present invention, which are mainly adopted to illustrate the embodiments, and explain the operating mechanism of the embodiments in accordance with relevant descriptions in the specification; with reference to the description below, those of ordinary skill in the art should be able to understand the possible embodiments other than those described herein, and the benefits of the present invention; elements shown in the figures are not drawn to scale, and the same or similar reference numerals always indicate the same or similar elements.

The following describes in details the present invention with reference to the accompanying drawings and embodiments.

Embodiment One

Figure 2:
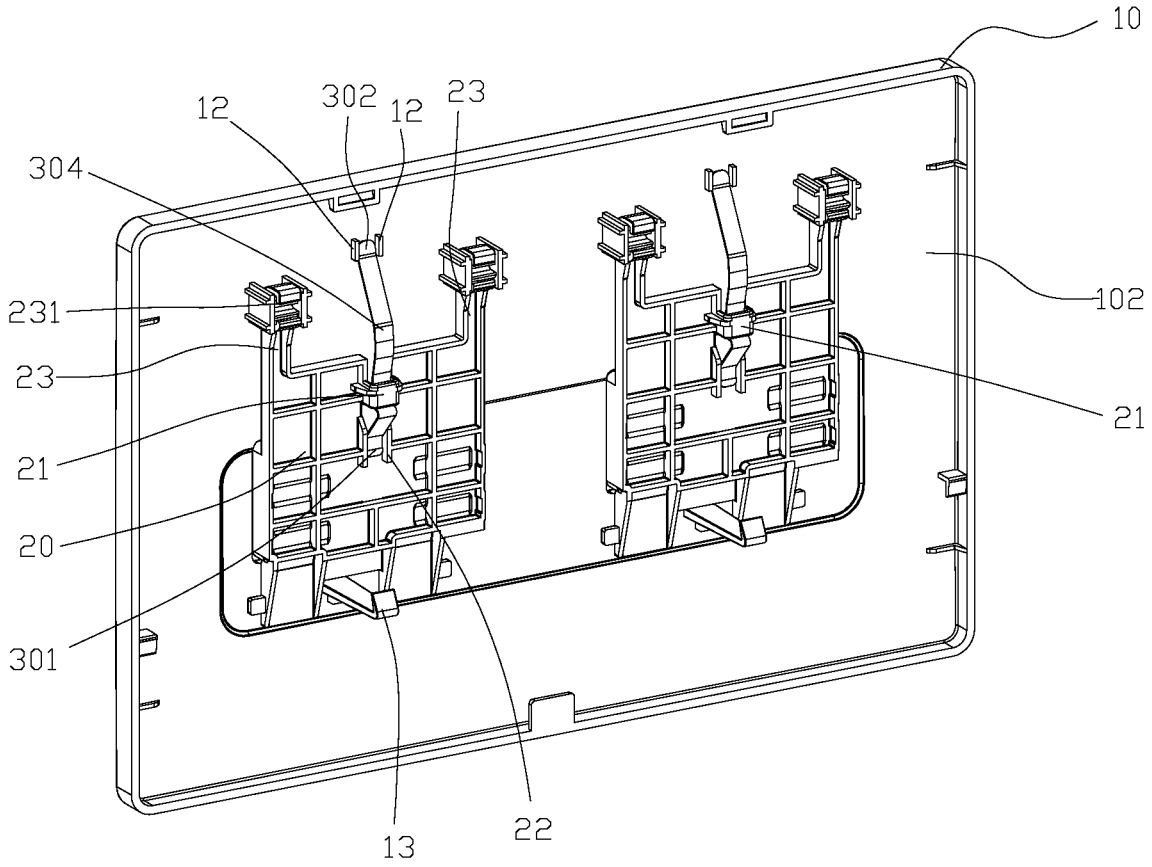
FIG. 2 shows a rear perspective view of the pressing panel of embodiment one in an initial state.
Figure 3:
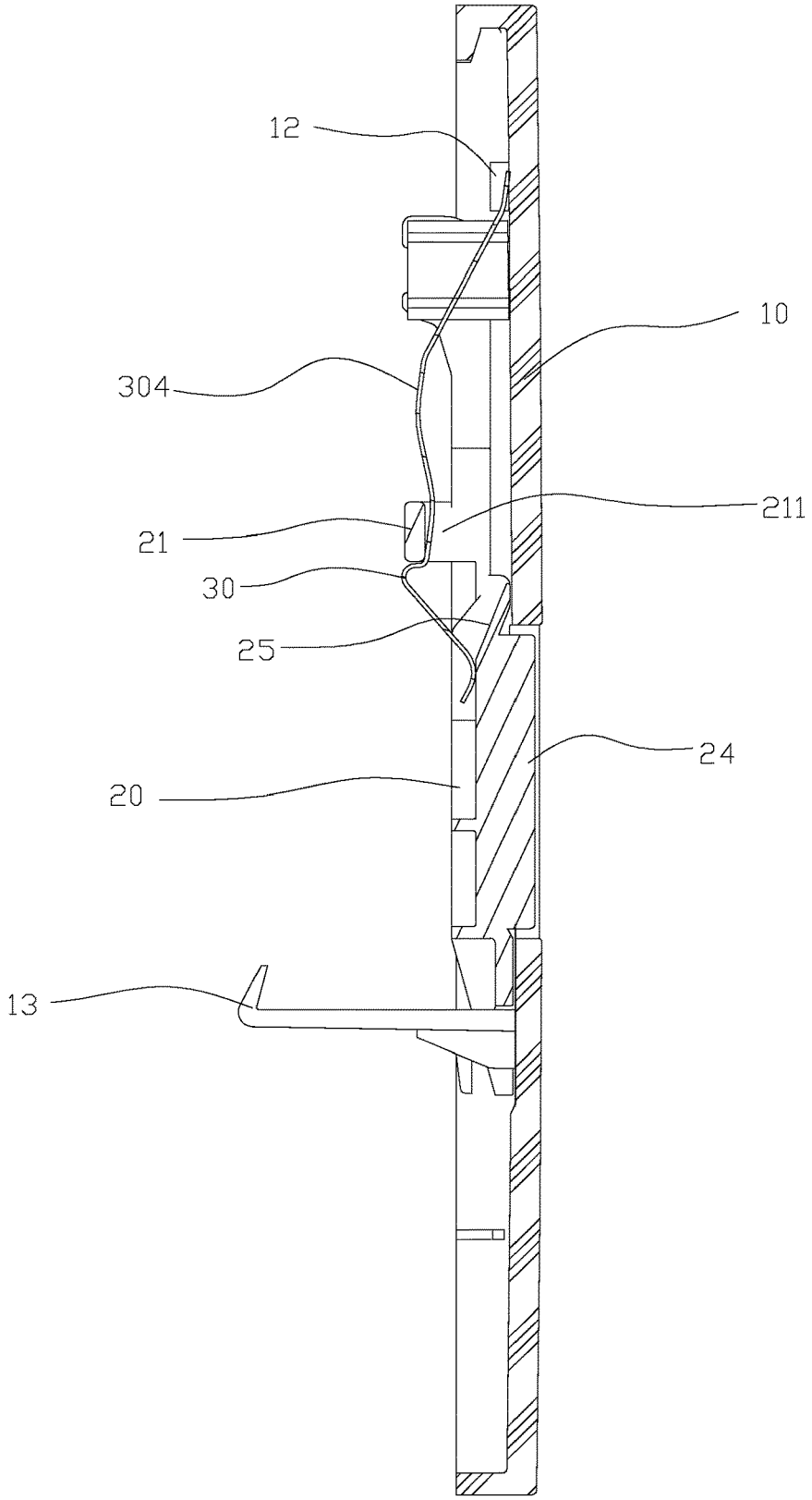
FIG. 3 shows a sectional view of the pressing panel of embodiment one in an initial state.
Figure 4:
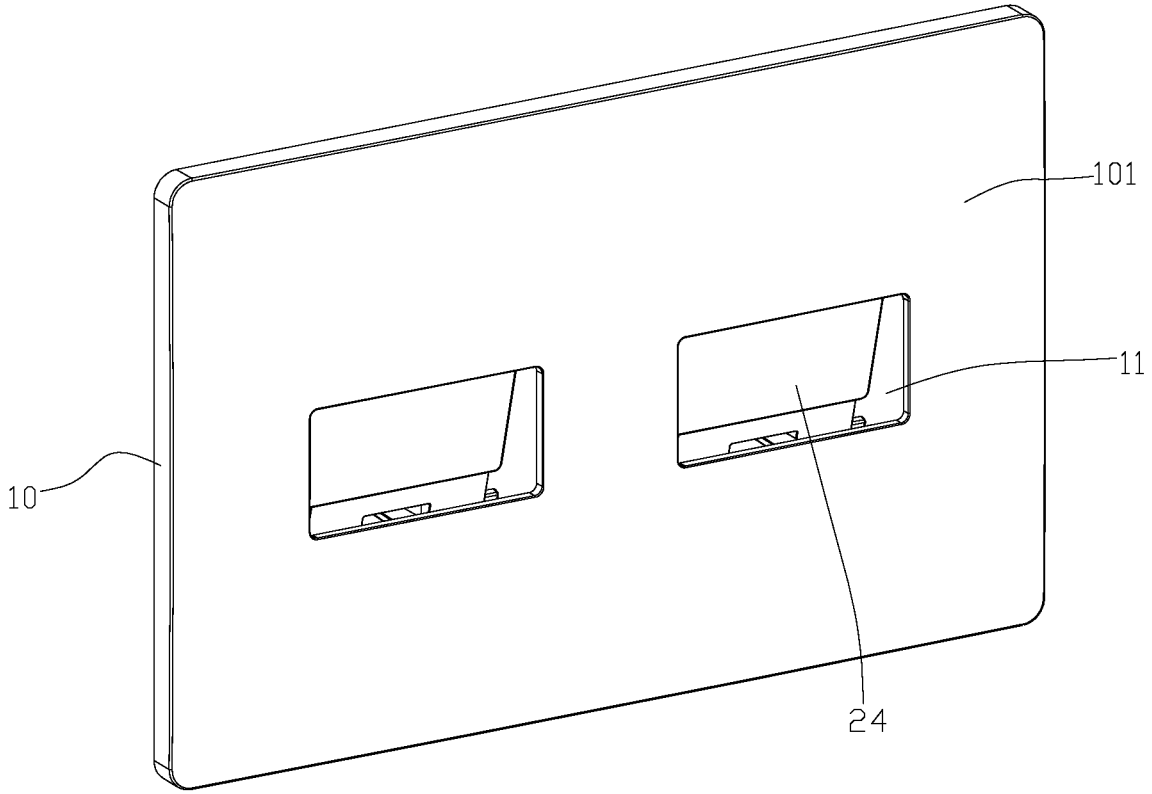
FIG. 4 shows a front perspective view of the pressing panel of embodiment one in a pressing state.
Figure 5:
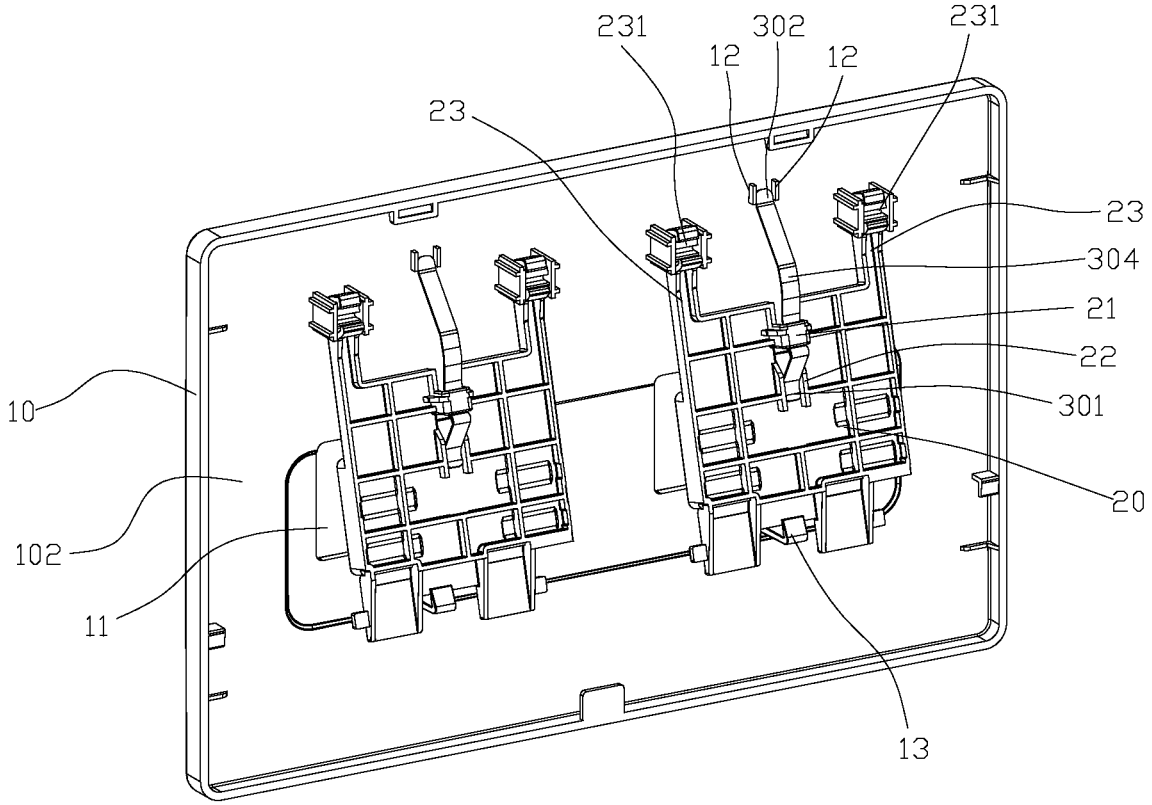
FIG. 5 shows a rear perspective view of the pressing panel of embodiment one in a pressing state.
Figure 6:
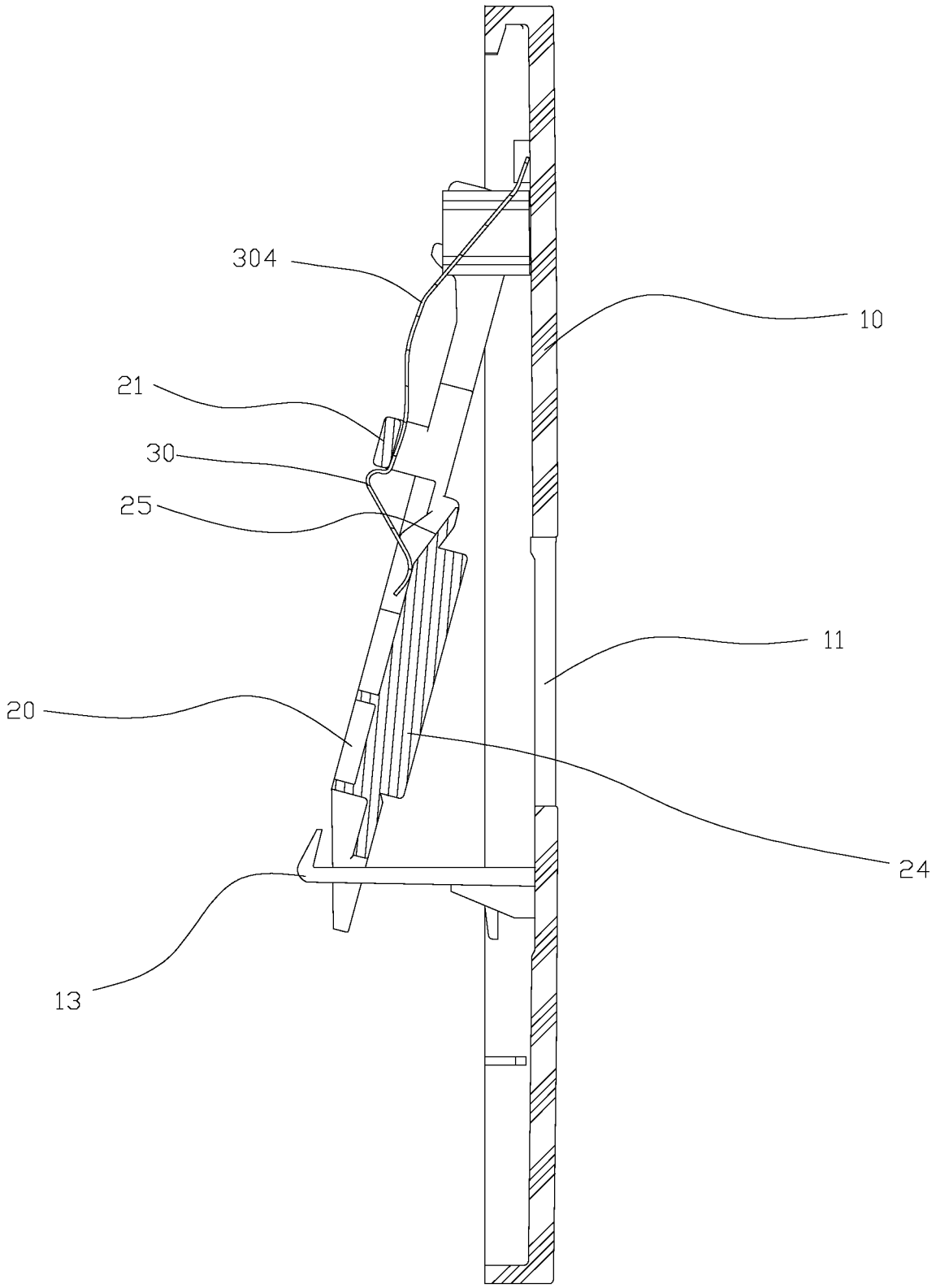
FIG. 6 shows a sectional view of the pressing panel of embodiment one in a pressing state.
Figure 7:
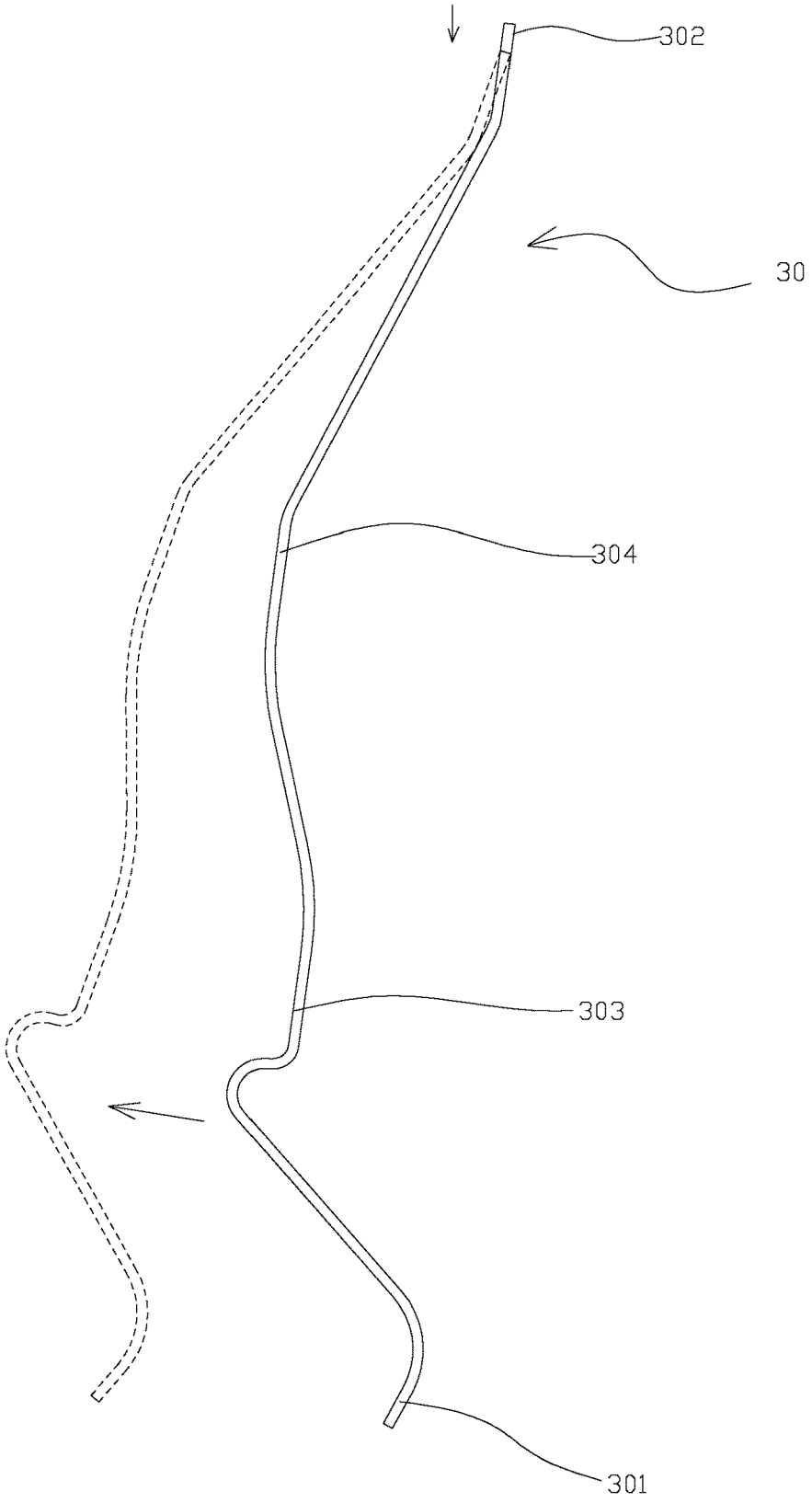
FIG. 7 shows a schematic view of the elastic piece of embodiment one in the states before and after pressing.

As illustrated in FIGS. 1-7, the present invention provides a pressing panel, comprising a panel 10, buttons 20 and elastic pieces 30; the buttons 20 are hinged to the panel 10, and each button 20 is movable with respect to the panel 10 through a pair of hinge shafts 231; each button 20 is fixedly provided with a corresponding elastic piece 30; each elastic piece 30 is provided with an elastic supporting arm 304 extending backwards corresponding to a direction which a corresponding button 20 moves when being pressed; each elastic supporting arm 304 abuts the panel 10 by elastic force; when each button 20 moves with respect to the panel 10 through the pair of hinge shafts 231, a portion of a corresponding elastic supporting arm 304 corresponding to an abutting position between the elastic supporting arm 304 and the panel 10 slides; when each button 20 is in an initial state before being pressed, as illustrated in FIGS. 2-3, the abutting position between the corresponding elastic supporting arm 304 and the panel 10 (namely a second end 302 described below), compared with a position of a corresponding pair of hinge shafts 231, is farther from a fixing position (namely a fitting base 21 described below) between the button 20 and a corresponding elastic piece 30; as illustrated in FIG. 3, the abutting position between the elastic supporting arm 304 and the panel 10 is at an upper position, the hinge shafts 231 are at a middle position, and the fixing position between the button 20 and the corresponding elastic piece 30 is at a lower position; when pressing each button 20, the corresponding elastic piece 30 moves along with the button 20, and a sliding motion of the elastic supporting arm 304 of each elastic piece 30 on the panel 10 effectively offsets the deformation of the elastic piece 30, so that the elastic deformation of the elastic pieces 30 is small, and therefore the rebound resistance against the pressing force of the buttons 20 is not large; when pressing the buttons 20 which are in an initial state, the buttons 20 rotate backwards by fifteen degrees, as illustrated in FIGS. 4-6; as illustrated in FIG. 7, a state of the elastic piece 30 before pressing is shown in solid lines, and a state of the elastic piece 30 after pressing is shown in dotted lines; the fixing position between the elastic piece 30 and the corresponding button 20 moves along with the corresponding button 20; a portion (namely the second end 302 described below) of the elastic supporting arm 304 corresponding to the abutting position between the elastic supporting arm 304 and the panel 10 slides downwards to offset deformation such that the elastic piece 30 hardly deforms; therefore, when pressing the buttons, additional pressing force required to overcome the rebounding resistance of the buttons 20 is small.

Figure 8:
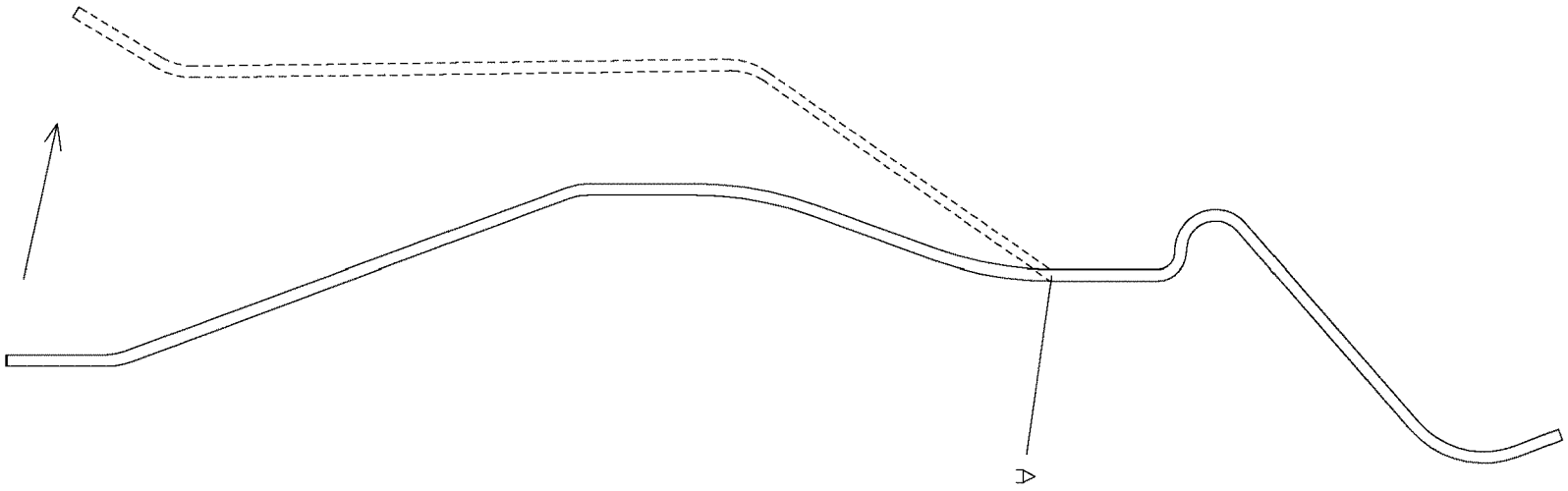
FIG. 8 shows a schematic view of the elastic piece of embodiment one mounted according to prior art method in the states before and after pressing.

If the elastic pieces 30 of the present embodiment are fixed by a method as in the prior art, namely fixing each elastic piece 30 on the panel 10, with each elastic supporting arm 304 abutting a corresponding button 20, and each elastic piece 30 also rotates backwards by fifteen degrees along with the corresponding button 20; each elastic piece 30 changes in position as illustrated in FIG. 8, wherein a state before pressing is shown in solid lines, and a state after pressing is shown in dotted lines; the elastic piece 30 starts deforming from fixing point A, resulting in greater deformation of the elastic piece 30; in view of the above, in comparison to the prior art, the present embodiment effectively reduces the deformation of the elastic pieces 30, so that the buttons 20 are easier and more comfortable to press.

Furthermore, in the present embodiment, the elastic pieces 30 are elongated flat springs; each elastic piece 30 is in an arched structure, and a middle part of each elastic piece is provided with a concave part 303; a fitting base 21 provided with a fitting hole 211 is formed on each button 20; each elastic piece 30 passes through a corresponding fitting hole 211; a first end 301 and a second end 302 of each elastic piece 30 abut a corresponding button 20 and the panel 10 respectively, wherein the concave part 303 at the middle part of each elastic piece 30 is fixedly fitted with a corresponding fitting base 21 by elastic force of the elastic piece 30 itself, thereby achieving the assembly of each elastic piece 30; each elastic supporting arm 304 is defined by an elastic part of each elastic piece 30 between the concave part 303 and the second end 302 thereof; by adopting the aforementioned configurations, assembly and disassembly of the elastic pieces 30 are more convenient; during assembly, insert the first end 301 of each elastic piece 30 into a corresponding fitting hole 211, and then press down an arched middle part of each elastic piece 30, so that the arched middle part passes through the corresponding fitting hole 211, until the concave part 303 is fitted with a corresponding fitting base 21; at this time, the first end 301 and the second end 302 of each elastic piece abut a corresponding button 20 and the panel 10 respectively; a portion between the first end 301 and the concave part 303 of each elastic piece 30 is a fixed portion; a portion between the concave part 303 and the second end 302 of each elastic piece 30 is an elastic portion, namely the elastic supporting arm 304.

Flat springs in an arched structure provide an elastic force to bias the flat springs to arch in order to ensure structural stability, thereby facilitating assembly; during disassembly, press a middle part of each elastic piece 30 so that the concave part 303 thereof stops abutting a corresponding fitting base 21, and then pull out each elastic piece 30 to complete disassembly.

More specifically, a guiding incline 25 is provided for each button 20 between the fitting base 21 of the button 20 and the abutting position between the button 20 and the first end 301 of a corresponding elastic piece 30; when inserting each elastic piece 30 during assembly, the assembly process is smoother under the guiding function of the guiding incline 25.

Specifically, a position limiting structure is provided on each button 20 at the abutting position of the button 20 and the first end 301 of a corresponding elastic piece 30; more specifically, the position limiting structure is defined by a pair of first protrusions 22 formed integrally with each button 20 on two sides of the corresponding elastic piece 30 respectively. The position limiting structure effectively performs position limiting function and prevents deviation during assembly.

Preferably, in the present embodiment, a position limiting groove extending along a sliding path of each elastic supporting arm 304 is provided on the panel corresponding to the abutting position of the elastic supporting arm 304 and the panel 10; specifically, the position limiting groove is defined by a pair of second protrusions 12 formed integrally with the panel 10 on two sides of the corresponding elastic piece 30. The position limiting groove performs position limiting function and prevents deviation of each elastic supporting arm 304 on the panel 10.

Specifically, in the present embodiment, the panel 10 is provided with a front surface 101, and a rear surface 102 provided on a back side of the front surface 101; the buttons 20 and the elastic pieces 30 are provided on the rear surface 102 of the panel 10; accommodating windows 11 are formed on the front surface 101 of the panel 10 corresponding to positions of the buttons 20 for users to press the buttons 20 at the accommodating windows 11; certainly, in other embodiments, structures of the panel 10 and arrangement of the buttons 20 should not be limited to those disclosed by the present embodiment; for examples, if the buttons 20 are exposed beyond a lower part of the panel 10, users may press the exposed portion of the buttons 20 exposed beyond the lower part of the panel 10; or, the buttons 20 may be hinged to a lower bottom side of the panel 10, while the abutting positions of the elastic pieces 30 remain unchanged and the elastic pieces 30 still abut the rear surface 102 of the panel 10, functions such as pressing and resetting can also be achieved.

Furthermore, each button 20 is provided with a convex pressing part 24 extending towards a corresponding accommodating window 11 for users to perform pressing; in the present embodiment, in an initial state of the buttons 20 before being pressed, the convex pressing parts 24 flush with the front surface 101 of the panel 10 to provide a beautiful appearance, but certainly, it should not be limiting; in some other embodiments, the convex pressing parts 24 may, for example, protrude out of the front surface 101 of the panel 10 for the ease of pressing.

Furthermore, in the present embodiment, the rear surface 102 of the panel 10 is provided with blocking hooks 13 extending backwards; when pressing each button 20, each button 20 rotates backwards to a certain degree and abuts a corresponding blocking hook 13; therefore, rotating degrees of the buttons 20 are limited by the blocking hooks 13 to prevent damages of internal components caused by excessive pressing depth.

Furthermore, in the present embodiment, two hinging columns 23 are provided above each button 20 at two positions spaced apart from each other respectively; each button 20 is hinged to the panel 10 through two corresponding hinging columns 23; a corresponding elastic piece 30 is provided between the two corresponding hinging columns 23, so that the distribution of force is more even; during resetting of the buttons 20, each button 20 being hinged to the panel 10 through the two corresponding hinging columns 23 above the button 20 at the two positions spaced apart from each other respectively allows each button 20 to reset with the help of its own weight so as to achieve better resetting effect; certainly, in other embodiments, the hinging columns 23 of each button 20 may be located at other sides (i.e. left side, right side, or even lower side) of the button to achieve hinging; when the hinging columns 23 of each button 20 are located at the left side or right side of the button, resetting of each button 20 is fully relying on the elastic force of a corresponding elastic piece 30; when the hinging columns 23 of each button 20 are located at the lower side of the button, the elastic piece 30 of each button needs to also overcome the weight of the button 20, resulting in poorer resetting effect.

Embodiment Two

Figure 9:
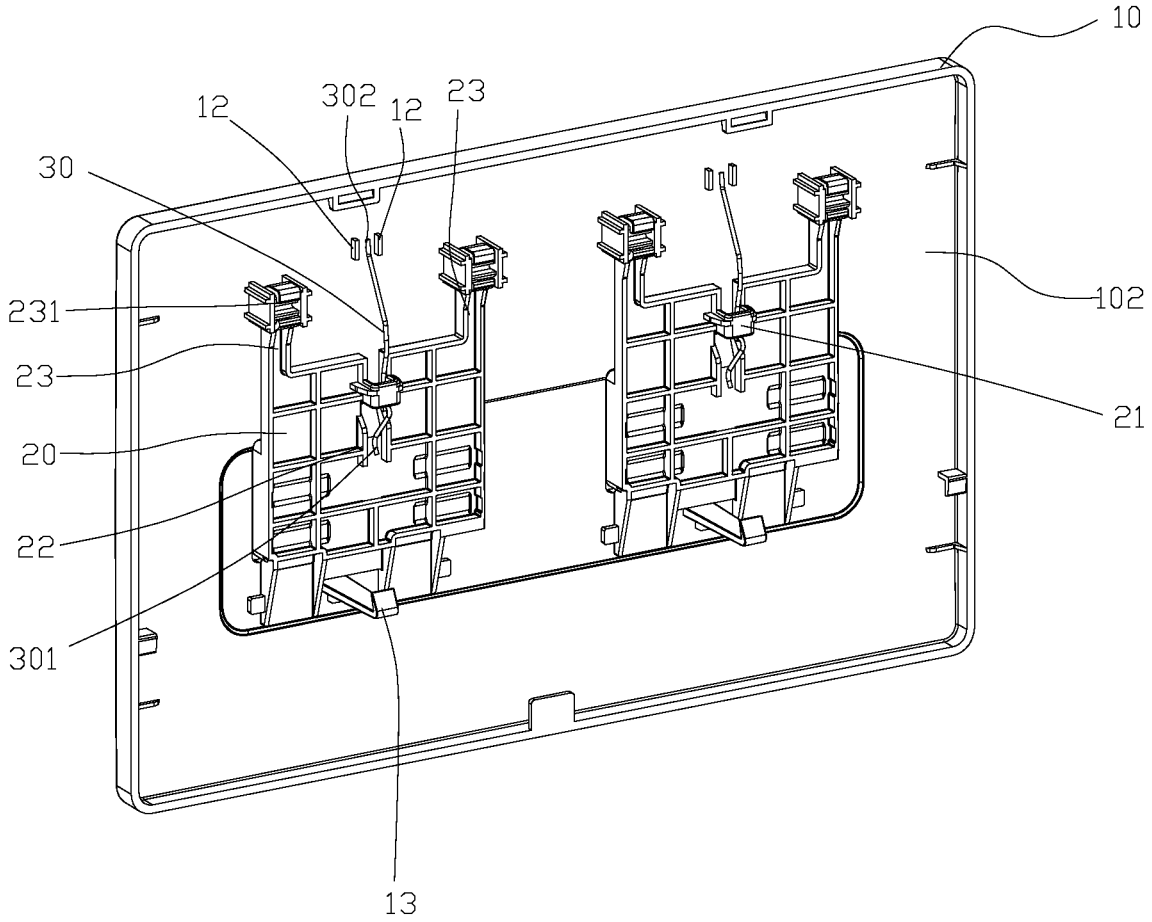
FIG. 9 shows a rear perspective view of the pressing panel of embodiment two.

The present embodiment provides a pressing panel, which has substantially the same structures as embodiment one, except for the following: as illustrated in FIG. 9, in the present embodiment, the elastic pieces 30 are elongated elastic threads, such as elastic metal wires; the structures and assembly of the elongated elastic threads are the same as the elongated flat springs of embodiment one, and thus will not be repeatedly described herein.

Embodiment Three

The present embodiment provides a pressing panel, which has substantially the same structures as embodiments one and two, with the same assembly of the panel 10 and the buttons 20, except that the elastic pieces 30 have different structural designs and the fixing method of the elastic pieces 30 with the buttons 20 is different. In this embodiment, each elastic piece 30 is only formed by the elastic supporting arm 304 of embodiments one and two; each elastic piece 30 is fixed on a corresponding button 20 by screw bolts or rivets; the elastic supporting arms 304 of the elastic pieces 30 extend backwards as disclosed in embodiments one and two.

Embodiment Four

Figure 10:
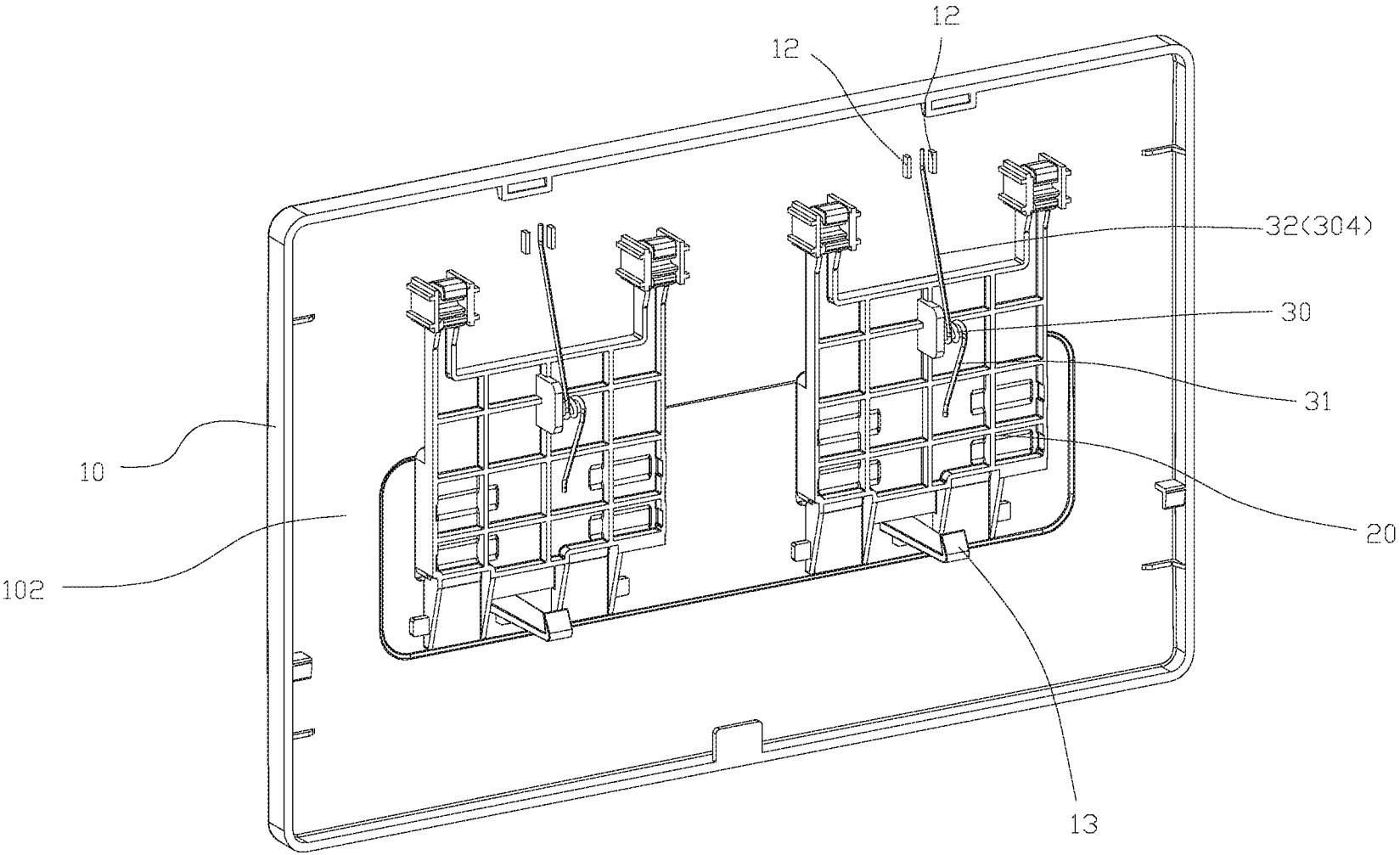
FIG. 10 shows a rear perspective view of the pressing panel of embodiment four.

The present embodiment provides a pressing panel, which has substantially the same structures as embodiment one, except for the following: as illustrated in FIG. 10, in the present embodiment, the elastic pieces 30 are torsion springs; each button 20 is provided with a fixing shaft (not shown in the drawings); each torsion spring is fixedly fitted with a corresponding fixing shaft, wherein a first supporting arm 31 of each torsion spring abuts a corresponding button 20, and a second supporting arm 32 of each torsion spring abuts the panel 10; the second supporting arm 32 of each torsion spring is equivalent to the elastic supporting arm 304 defined in embodiment one; torsion springs are conventional elastic components commonly adopted in the prior art, which can be easily obtained from the market without the needs of customization, and are convenient to assemble.

Although the description above provides the preferable embodiments to illustrate and explain the present invention, it should be understood by those skilled in the art that, various modifications in forms and details without departing from the essence and scope of the present invention as defined by the appended claims, shall also fall within the protection scope of the present invention.

What is claimed is:

1. A pressing panel, comprising:

a panel, buttons and elastic pieces;

the buttons are hinged to the panel, and each button is movable with respect to the panel through a pair of hinge shafts;

wherein each button is fixedly provided with a corresponding elastic piece;

each elastic piece is provided with an elastic supporting arm extending backwards corresponding to a direction which a corresponding button moves when being pressed;

each elastic supporting arm abuts the panel by elastic force;

when each button moves with respect to the panel through the corresponding pair of hinge shafts, a portion of a corresponding elastic supporting arm corresponding to an abutting position between the corresponding elastic supporting arm and the panel slides; and when each button is in an initial state before being pressed, the abutting position between the corresponding elastic supporting arm and the panel, compared with a position of the corresponding pair of hinge shafts, is farther away from a fixing position between the button and the corresponding elastic piece.

2. The pressing panel of claim 1, wherein the elastic pieces are elongated flat springs or elongated elastic threads.

3. The pressing panel of claim 2, wherein each elastic piece has an arched structure, and a middle part of each elastic piece is provided with a concave part;

a fitting base provided with a fitting hole is formed on each button; each elastic piece passes through a corresponding fitting hole;

a first end and a second end of each elastic piece abut the corresponding button and the panel respectively, wherein the concave part at the middle part of each elastic piece is fixedly fitted with a corresponding fitting base by elastic force of the elastic piece itself; and each elastic supporting arm is defined by an elastic part of the corresponding elastic piece between the concave part and the second end thereof.

4. The pressing panel of claim 1, wherein the elastic pieces are torsion springs.

5. The pressing panel of claim 4, wherein each button is fixedly fitted with a corresponding torsion spring, wherein a first supporting arm of each torsion spring abuts the corresponding button, and a second supporting arm of each torsion spring abuts the panel; and the elastic supporting arm is embodied as the second supporting arm when the elastic pieces are torsion springs.

* * * * *